United States Patent [19]

Hsiao

[11] 3,960,094

[45] June 1, 1976

[54] AUTOMATIC BUTTON POSITIONING APPARATUS

[75] Inventor: James C. Hsiao, Chicago, Ill.

[73] Assignee: Union Special Corporation, Chicago, Ill.

[22] Filed: Nov. 6, 1974

[21] Appl. No.: 521,432

[52] U.S. Cl. ..... 112/110; 112/113

[51] Int. Cl.[2] ..... D05B 3/14

[58] Field of Search ..... 112/106, 110–114; 221/173, 133, 156, 186, 267, 270, 274, 123, 183, 176, 268, 271; 198/33 R, 22 R, 43

[56] References Cited

UNITED STATES PATENTS

| | | | |
|---|---|---|---|
| 2,665,651 | 1/1954 | Fagle | 112/113 |
| 3,670,673 | 6/1972 | Winston et al. | 112/113 |
| 3,807,328 | 4/1974 | Lombardo | 112/113 |
| 3,863,579 | 2/1975 | Rockerath et al. | 112/113 |

*Primary Examiner*—G. V. Larkin

*Attorney, Agent, or Firm*—John A. Schaerli

[57] ABSTRACT

Apparatus for delivering buttons to and positively removing them from a sewing station after they have been secured to a fabric. A button loader feeds buttons to a button conveyor which moves them through a sequence of steps. An indexing means actuates the conveyor as well as an orientating means which aligns the buttonholes for the sewing step. After the sewing step a means operates on the button and attached fabric to force disengagement with the conveyor.

15 Claims, 20 Drawing Figures

72
66
68
76
110
38
183
86
98
190
186
172
102
200
85
109
112
168
181
170
184
70
199
196
30
39
37
75
36
178
300
302
174
104
100
162
96
84
106
80
304
78
306
94
90c
82
114
116
90a
90b
105
156
154
150
152
128
146
148
134
140
138
42
132
143
136
126
142
130
214
212
260
281
273
206
275
261
250
277
263
268
279
258
264
88
122
70
36
80
90c
90a
42
47
48
54
52
44
50
62
56

AUTOMATIC BUTTON POSITIONING APPARATUS

This invention relates to automatic button positioning mechanisms and more particularly to an apparatus for a button sewing machine which delivers buttons to and removes them from the sewing station.

BACKGROUND OF THE INVENTION

Innumerable machines have been designed to hold an oriented button during the sewing cycle of a button sewing machine. Some of these devices require an operator to manually insert the button therein, as well as manually orientate it, while others employ an automatic feed and orientating mechanism with the subsequent manual removal thereof after the sewing cycle is complete. As is apparent, any type of procedure which involves manual effort on the part of the operator is going to involve correspondingly high labor costs. However, any system which is automatically performed must do so without the possibility of error. That is, if the button is improperly positioned the needle may very likely come down thereupon and break. This is not only costly, but the flying needle parts present a substantial danger to the operator.

As has been stated, the prior art discloses machines which have attempted to automatically feed and position the button at the sewing station of the button sewing machine. These machines, however, do not provide a positive button ejection system once the sewing cycle has been completed. In some cases the operator must manually pull the button from the apparatus, and in other instances the action of the button feeder or the next adjacent button in line forces the sewn button from the apparatus. In view of the fact some of these devices are driven by means independent of the button sewing machine, the possible hazards due to needle breakage on an improperly orientated or jammed button can be appreciated.

It is, therefore, an object of this invention to provide an apparatus for delivering buttons to and removing them from the sewing station of a button sewing machine. Another object of this invention is to provide an apparatus for delivering buttons to and removing them from the sewing station which is synchronized with and driven by the sewing machine actuation assembly. Still another object of this invention is to provide a method for automatically delivering and then removing the button and fabric from the sewing station. Another object of this invention is to provide an apparatus for delivering buttons to and removing them from the sewing station which includes a positive indexing means whereby the apparatus can move only in a predetermined increment. Still another object of this invention is to provide an apparatus for delivering buttons to and removing them from the sewing station, which is mounted on the clamping mechanism of a button sewing machine. Another object of this invention is to provide an apparatus mounted on the button sewing machine which in combination with the thread, material and fabric, positively eject the button from the button delivery means. Still another object of this invention is to provide a thread clipping means which advances, cuts and withdraws during the clipping work cycle. Another object of this invention is to provide a positive button removal means which forces the button from the sewing station after the button has been secured to the fabric. Still another object of this invention is to provide a positive button removal means which removes the sewn button whether there is another button in line to be sewn or not. Further objects of the invention will become apparent from the description, drawings and claims which follow hereafter.

SUMMARY OF THE INVENTION

The invention hereunder consideration is an apparatus for delivering buttons to and positively removing them from the sewing station of a button sewing machine. This procedure provides a positive ejection whereby once the button has been sewed or otherwise secured to the fabric it is ejected from the apparatus as the apparatus performs the next step of its work cycle.

A device such as the "Syntron Type EBOOE" manufactured by the FMC Corporation of Homer City, Pennsylvania, is a suitable device for orientating and feeding the buttons to the apparatus of the invention hereunder consideration. The FMC Corporation device includes a hopper which aligns the buttons topside up, and a chute for vibration and gravity feeding of buttons to a button conveyor means.

Located in the outer edge or at least located in the body of the button conveyor are button securing recess means designed to accept buttons from the button feeder or loader as described above. The button conveyor is moved through a series of predetermined steps by an indexing means which is in turn driven off the main actuating system of the sewing machine. In one of the predetermined steps an orientating means is operatively moved to engage and position the buttonholes such that they correspond to the sewing pattern of the needle. In the final step or the sewing station the button is secured to a fabric, etc., employing some type of thread means. Subsequent to this step the clamp means of the button sewing machine, to which the invention hereunder consideration is secured, is raised to a fabric disengaging position. As this function is transpiring the button which has been secured to the fabric is forcibly removed from the recess means and the indexing means actuates the conveyor to complete that work cycle. During this time the thread clipping means is also actuated whereby the necessary thread is cut.

The invention will be further understood from the following description and drawings in which.

Figure 3:
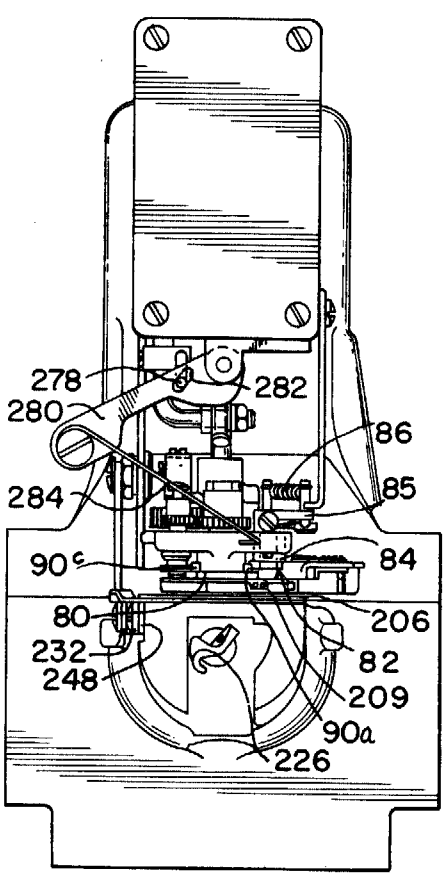
Figure 1:
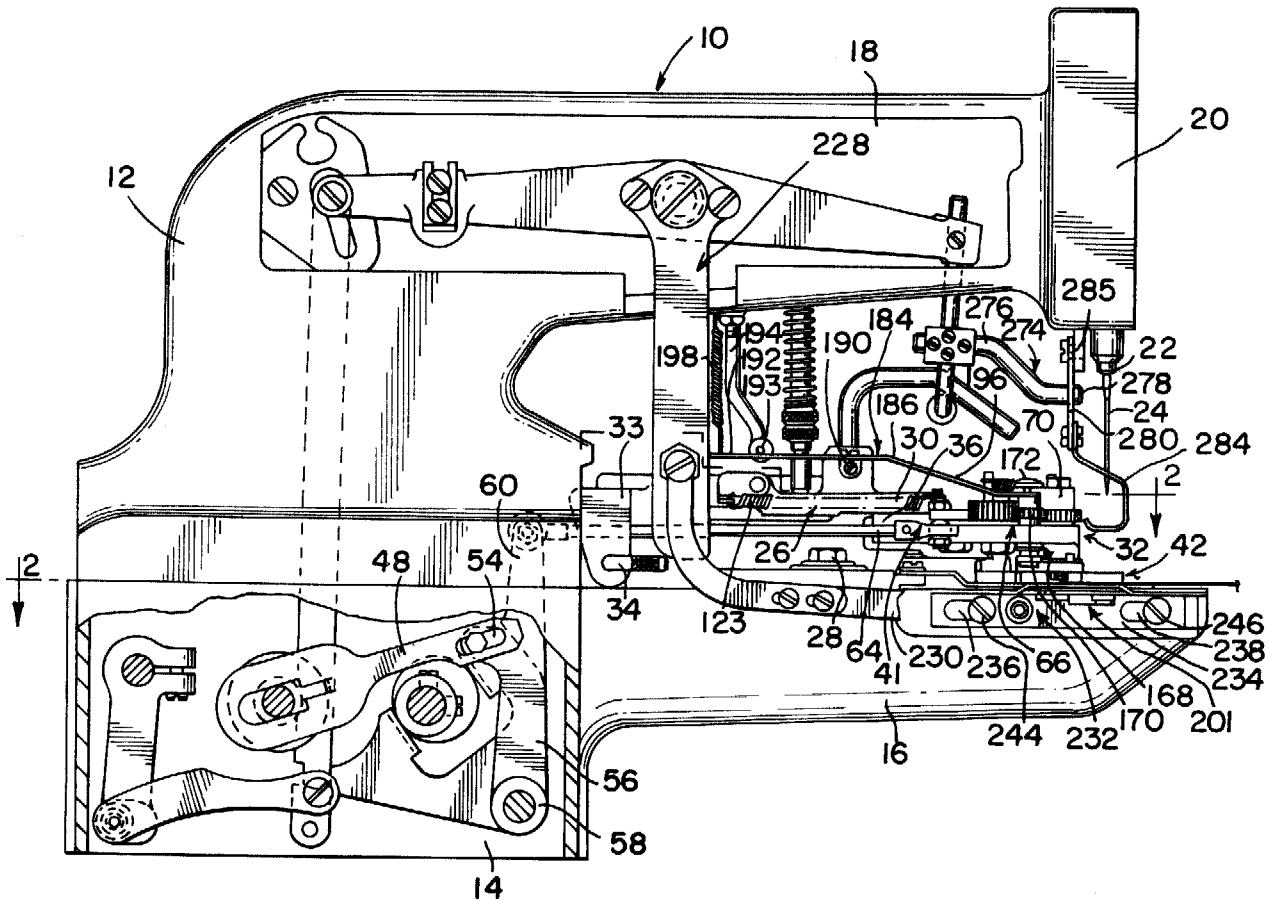
FIG. 1 is a side view of a button sewing machine partially broken away, showing the apparatus of the invention hereunder consideration secured to the sewing machine clamp which is in a fabric engaging position.
Figure 2A:
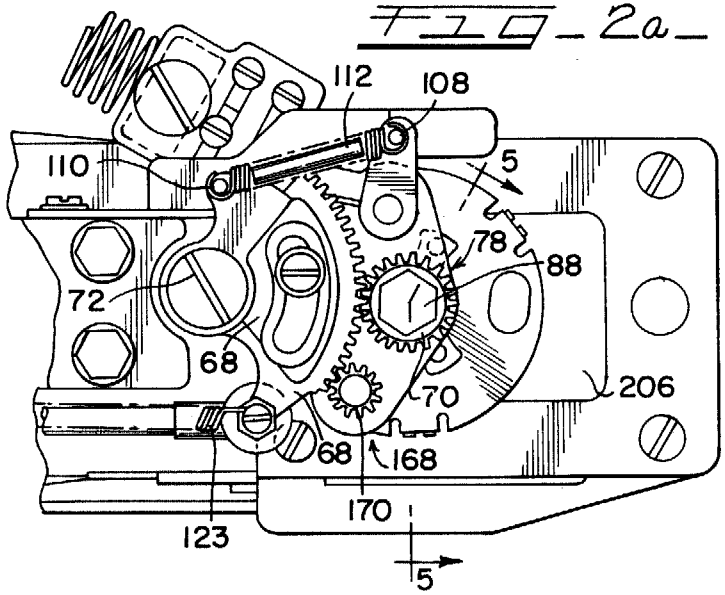
FIG. 2 is a top view of FIG. 1 partially broken away, taken along the lines 2—2 thereof showing the apparatus in an unloaded orientation.
Figure 2:
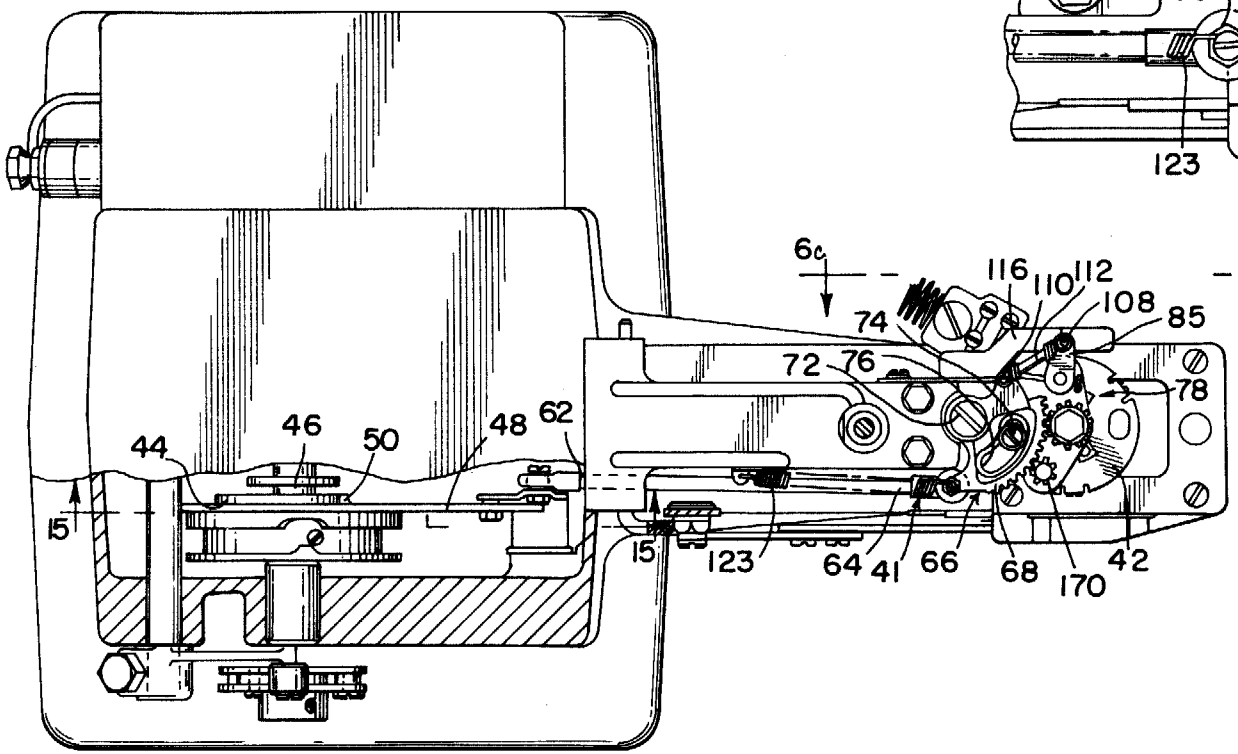
Figures 4, 5:
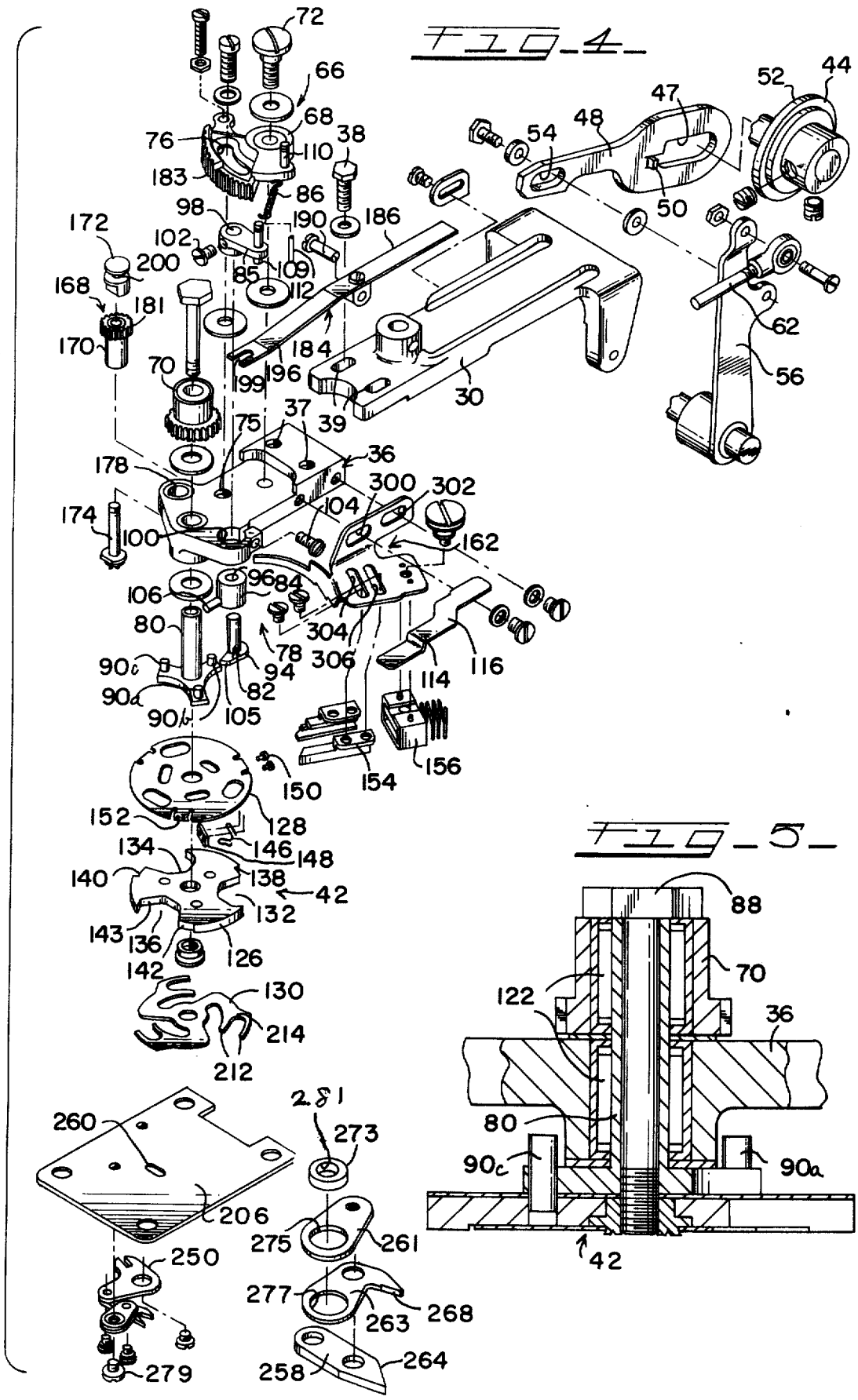
Figure 6:
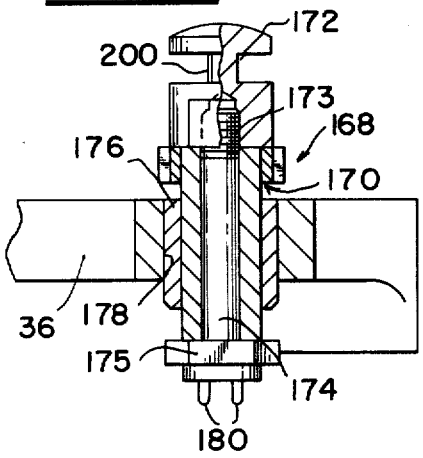
Figure 6A:
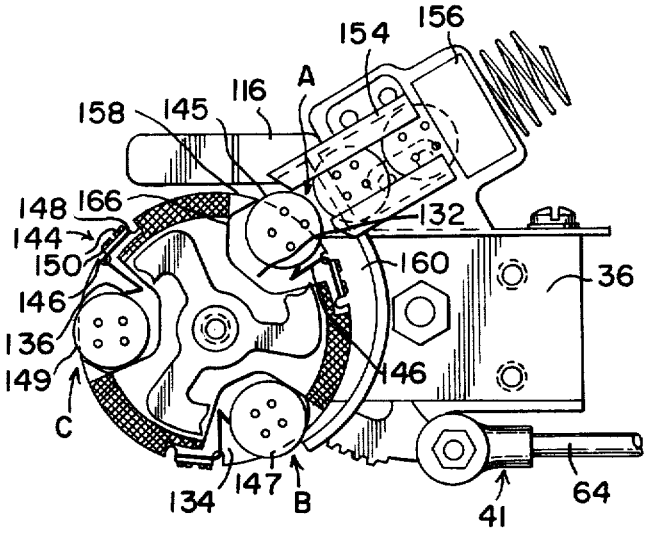
Figure 6B:
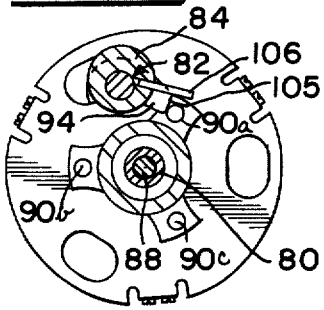
Figure 6C:
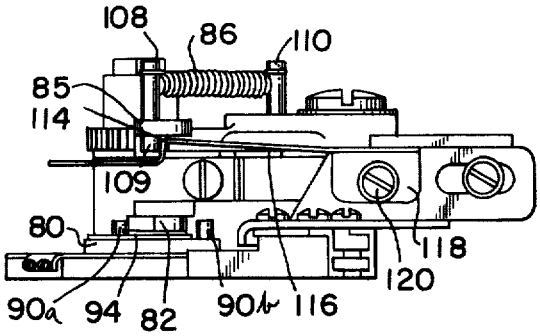
Figure 7:
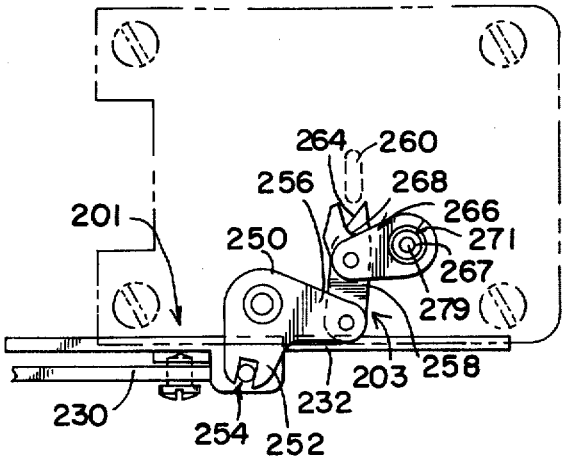
Figure 8:
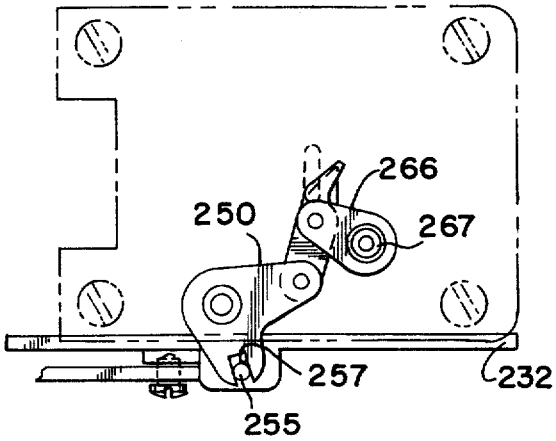
Figure 9:
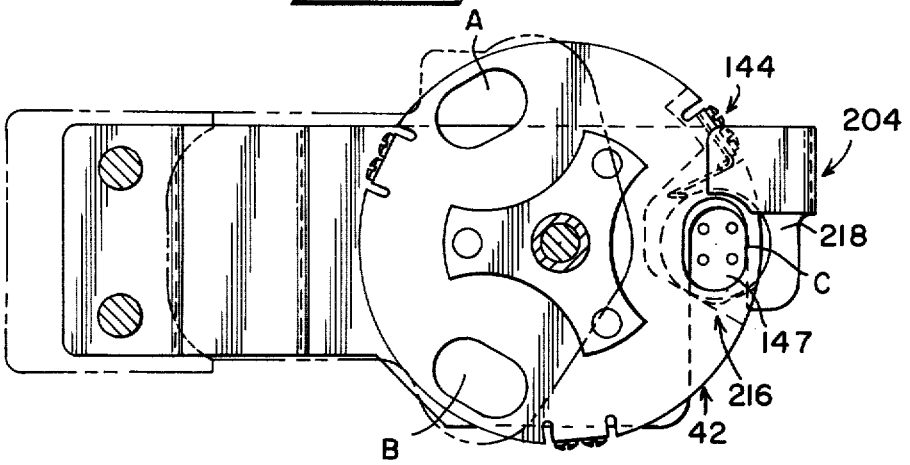
Figure 10:
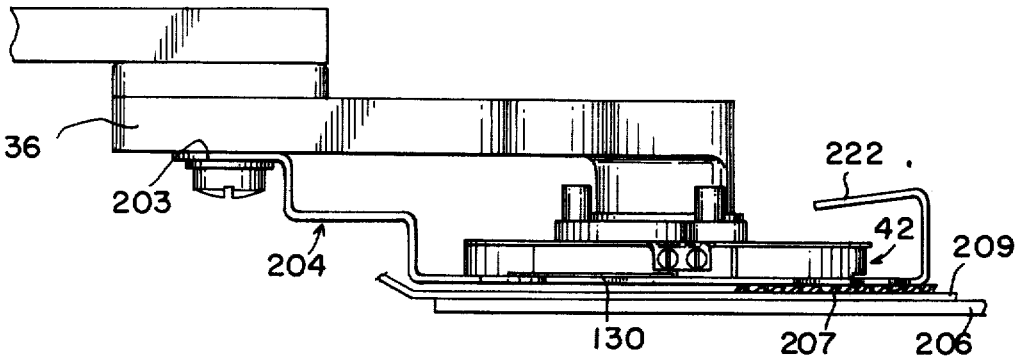
Figure 11:
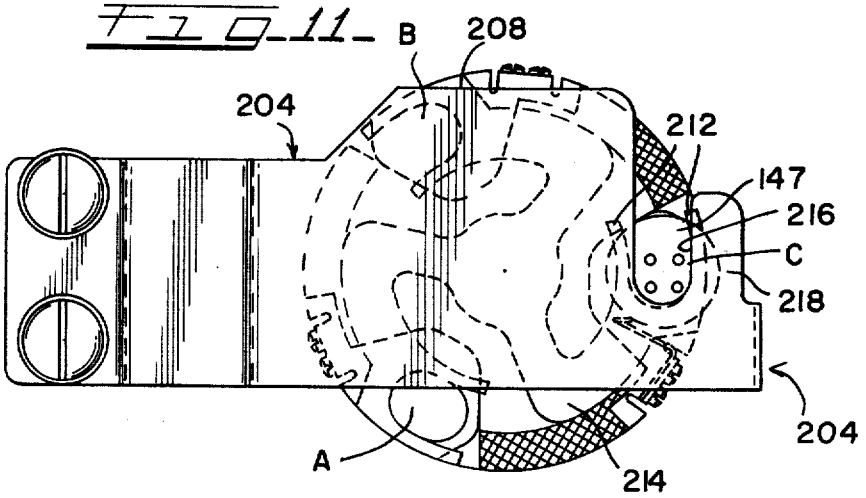
Figure 12:
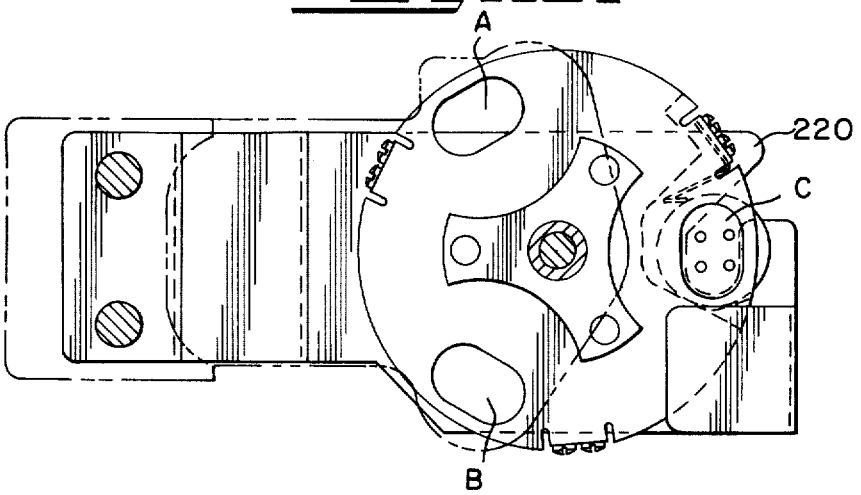
Figure 13:
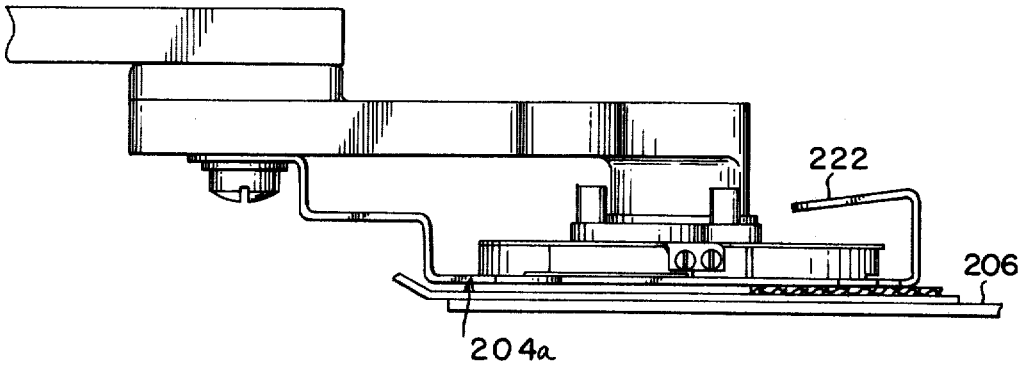
Figure 14:
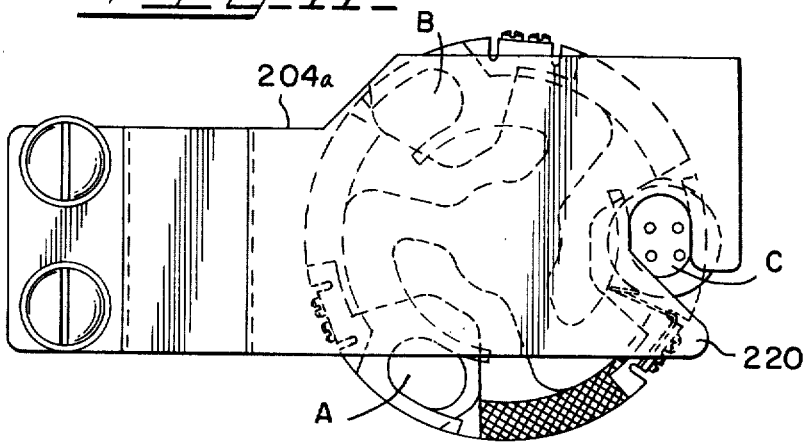
Figure 16:
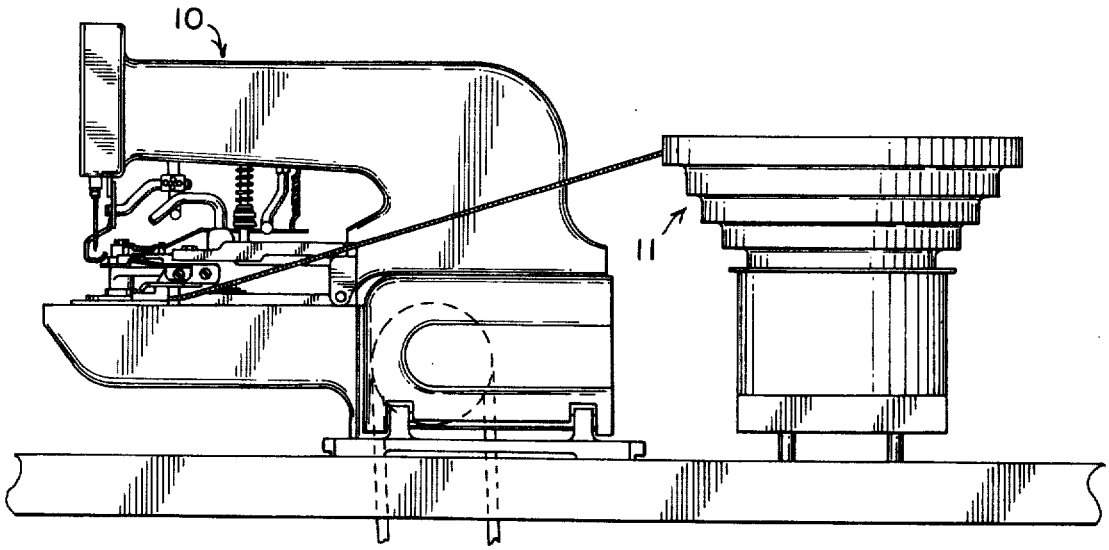
Figure 15:
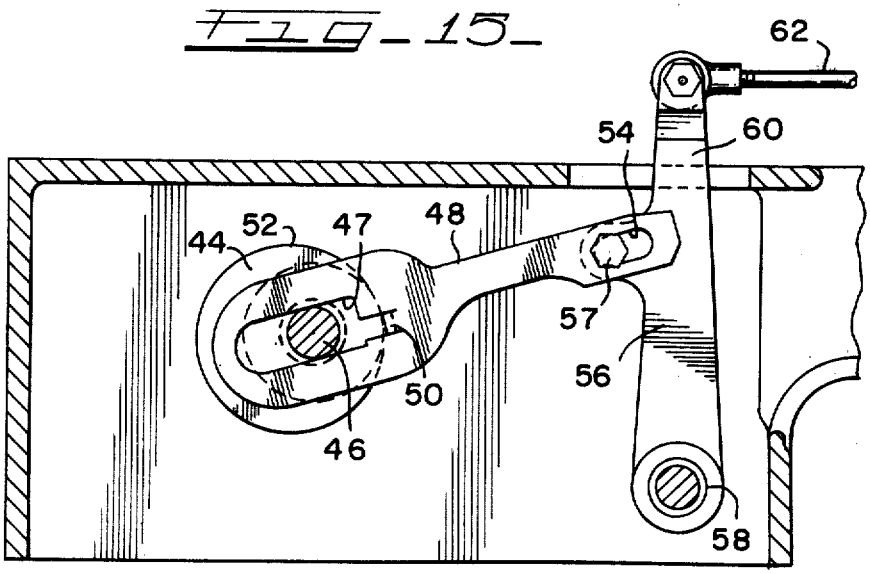

FIG. 2*a* is a partial view of FIG. 2 showing the apparatus in a loaded orientation;

FIG. 3 is a partial front view of FIG. 1;

FIG. 4 is an exploded view of the automatic button positioning and rejection means as well as a portion of the sewing machine clamp means;

FIG. 5 is a partial view taken along line 5–5 of FIG. 2*a*;

FIG. 6 is a partial cross-sectional view of the button orientating means;

FIG. 6*a* is a bottom view of the button positioning means as shown in FIG. 2;

FIG. 6*b* is a partial top view of the button conveyor means;

FIG. 6c is a partial side view looking along line 6c—6c of FIG. 2 of the button conveyor means with the button chute removed;

FIGS. 7 and 8 show the thread cutting means in an unengaged and engaged position;

FIGS. 9, 10 and 11 show top, side and bottom views of the button conveyor and positive button reject means designed for use with a button sewing machine which indexes to the left;

FIGS. 12, 13 and 14 show top, side and bottom views of a button conveyor and a second embodiment of the button reject means designed for use with a button sewing machine which indexes to the right;

FIG. 15 is a view of the actuation assembly taken along line 15—15 of FIG. 2; and FIG. 16 is a side view of the entire assemblage showing the invention hereunder consideration secured to a button sewing machine with an attendant button feeder.

The sewing machine illustrated in the drawings wherein is embodied the present invention is a group stitch machine of the general type disclosed in; U.S. Pat. No. 2,609,773 to Nelson granted Sept. 9, 1962, U.S. Pat. No. 3,509,838 to Bowin granted May 5, 1970 and, U.S. Pat. No. 3,749,041 also to Bowin granted July 31, 1973. The type of machine shown in these patents is a button sewing machine which includes a positionable work clamping means which is moved into clamping engagement with a fabric at the beginning of the sewing cycle and lifted away therefrom after a predetermined number of stitches have been employed to secure the button to the fabric or workpiece. A button can be either manually or mechanically positioned in the desired location to accomplish the sewing step. Accordingly, the showing of the machine here is greatly simplified and only certain key parts will be specifically referred to inasmuch as reference of specific details, etc., are disclosed in the above identified U.S. patents.

Referring now to the drawings and more particularly to FIG. 1 wherein is shown a button sewing machine 10 which has an enclosed frame including a vertical stand means 12 having a base portion 14 which is arranged for mounting upon a suitable support (not shown). Extending horizontally, and for the purposes of this description, forwardly from the base portion 14 is a work supporting arm means 16. Above the latter and extending outwardly and forwardly from the vertical stand 12 of the frame is an overhanging arm means 18, which at its forward end has a head 20 in which is mounted a vertical reciprocal needle bar means 22 adapted to carry a needle 24 for movement to the work supported upon arm 16. As disclosed in substantial detail in the above identified U.S. patents, the work supporting and clamping means 26 is pivoted about a pivot screw 28 movable to a selection of positions to select the length of stitch made during a work cycle. The work clamping device 26 also includes a bracket means 30 which has secured to the forward end thereof the button delivery and removal assembly means 32. At the rearward end of bracket 30 is a depending lug assembly which includes vertically extending spaced apart lug means 33 which are pivotally mounted on a pin means 34 whereby movement in a vertical plane is allowed. As is apparent, this provides the button delivery and removal assembly 32 with controlled predetermined movement in a vertical plane to clamp a fabric to the arm means, in a horizontal plane to provide the proper stitch pattern, and then in a vertical plane to allow release of the fabric or workpiece after the work cycle has been completed.

The delivery and removal button means 32 which comprises the invention hereunder consideration is secured to the bracket means 30 of clamp means 26 via frame section means 36, any suitable means such as a series of tapped hole means 37, screw means 38, and corresponding aperture means in the frame means 36, such as 39 may be employed. As is apparent the button delivery and removal means 32, because of its secured connection to the clamp means, will follow all movements of clamp means 26. The frame means 36 that supports the elements which move, orientate and eject the sewn button will be hereafter described.

Referring now to FIGS. 1, 2, 4 and 15, the driving or indexing means 41 which moves the button conveyor means 42 through a series of predetermined steps will be described. An off-center cam means 44 is driven off a transmitting shaft of the sewing machine 46. As shown in FIG. 15, a drive lever pusher means 48 has an elongated slot 47 journaled by the drive shaft means 46. The drive lever pusher means 48 is secured in adjacent sliding relationship with the off-centered cam means 44 such that a tab means 50 extending from one end of the elongated slot 47 always maintains contact with the outer peripheral surface 52 of the eccentric cam. As is apparent, as the eccentric cam means 44 passes through a complete revolution, the drive lever pusher means 48 will reciprocate from the left to the right as long as the tab means 50 slides on the outer circumference means 52. A certain degree of slack or dead time is built into the assembly by the provision of the slot means 54. This force is transferred to drive lever means 56 via support pin means 57. At first end means 58, drive lever means 56 is pivotally secured to the frame of the sewing machine 10, and at the second end means 60 a horizontally extending connecting rod means 62 is pivotally secured. For a more complete description of this assembly reference should be made to my co-pending Patent Application Ser. Number 509,957 filed Sept. 27, 1974, now U.S. Pat. No. 3,894,500.

The connecting rod means 62 extends outwardly to the right over the arm means 16 and adjacent to the bracket means 30 having a second end means 64 secured to a rack and pinion assembly means 66. The rack and pinion assembly means 66, referring to FIG. 4, includes drive gear means 68, and spur gear means 70. In operation connection rod 62 moves to the left or right causing the drive gear means 68 to pivot about screw means 72. The proper alignment therewith is maintained by a track and pin carrying means 74 in an aperture 76, both of these members being suitably secured, such as by a threaded hole 75, to the support bracket or frame means 36. The rack and pinion assembly means 66 drives a positive sequential locking assembly means 78. As shown in FIGS. 4 and 5, this assembly includes a buttonholder chuck means 80, an escapement means 82, an eccentric sleeve means 84, a lever means 85 and a spring means 86. Referring to FIG. 5, a bolt means 88 is employed to confine the spur gear means 70 to the buttonholder chuck means 80 in a manner whereby movement of the spur gear 70, in only one direction, is transferred to buttonholder chuck 80. In order to control the movement and insure that it is in or takes place in a predetermined sequence, vertically extending pin means 90a, 90b and 90c are provided on the lower extremes of the buttonholder chuck 80. As shown in FIGS. 2, 6*b* and 6*c*, the escapement means 82 has a projection means 94.

The projection means 94 journals a correspondingly and suitably designed aperture means 96 located in eccentric sleeve means 84 as well as aperture means 98 located in lever means 85. All of these elements are secured in the proper orientation by a suitable means and are carried by and partially within aperture means 100 located within support bracket 36. A first screw means 102 is employed to secure the upper extremes thereof and a second screw means 104 clampingly secures eccentric sleeve means 84 within the aperture 100. As shown in FIG. 6*b*, the leading edge 105 of projection means 94 is in binding contact with pin means 90*a* thereby preventing any rotational movement in a counterclockwise direction of the entire assembly.

The particular orientation of the parts of the positive sequential locking assembly 78 shown in FIG. 2 corresponds and reflects the position as shown in FIG. 6*b*. It should be noted that the distance between the pin means 108 mounted on lever means 85 and the pin means 110 mounted on drive gear means 68 is maintained at a given constant minimum distance by the provision of a flexible resilient pin means 112 positioned within the spring means 86 such that a given distance the ends of the rod means butt the two pin means, one at each end and thus prevents any further movement in that direction therebetween. As shown in FIGS. 2 and 6*c*, once the positive sequential locking means 78 is in this position any movement in a counterclockwise rotational manner about pin means 94 is prohibited by the abutment of the lower end means 109 of pin 108 on the shoulder means 114 of release spring means 116. The release spring 116, as shown in FIG. 6*c*, flexes in a vertical direction, (top to bottom of page) and is provided with an integral lug means 118 having an aperture therein which is suitably secured to the support frame means 36 by a threaded bolt assembly 120.

It will be appreciated that if the release spring 116 is bend downwardly when the system is in a loaded position, as shown in FIG. 2*a*, lever 85 will by spring 86 be pulled rearwardly or to the left. This rearward motion will continue until the pins and rod abut. Thereafter as drive gear 68 rotates in a clockwise direction it will move pin 110 generally along a forwardly directed arc, such that via rod 112 and pin 108 the lever means 85 is moved to the right to a point where pin 109 can again abut shoulder means 114.

Referring now to FIGS. 2 and 5, it will be noted the indexing assembly means 66 is provided with a one-way force delivering clutch means 122. Such one-way clutch means are well-known in the art and therefore no explanation will be devoted thereto. In operation the one-way force delivering clutch means 122 allows the free clockwise movement of spur gear 70 about chuck means 80 and related assemblies. Such an action allows the drive gear means 68, as shown in FIG. 2, to pivot freely about pin 72 in a counterclockwise direction and without any force transfer to the buttonholder chuck means 80 and related assemblies. This allows, via the off-centered cam means and drive lever pusher, drive lever and connecting rod, as previously discussed, to freely pivot the drive gear 68 about pin means 72 in a counterclockwise direction. The elements in this loaded position are shown in FIG. 2*a*. A spring means 123, as shown in FIG. 1, resists this counterclockwise movement of drive gear means 68 and continuously urges it in a clockwise direction, such as shown in FIG. 2. However, when the drive gear 68, once loaded, attempts to move in a clockwise direction, under the urging of spring means 123, the clutch means 122 are engaged and force is transferred to the buttonholder chuck and related elements. Movement of these elements is prevented by the abutment (as shown in FIG. 6*b*) of pin 90*a* and the leading edge 105, this assembly in turn being maintained in the position as shown by the abutment of pin 109 and shoulder 114 of locking lever or spring means 116 as shown in FIG. 6*c*. It will be noted from FIG. 2*a* that in the loaded position, spring means 86 is under tension and attempting to pull pin means 108 toward pin means 110 or vice versa, thus necessitating the butting relationship between the section of pin 109 and shoulder means 114.

Removably secured to the lower end means of pins 90*a*, 90*b* and 90*c* of buttonholder chuck means 80, is the button conveyor means 42. As shown in FIG. 4, the button conveyor means 42 in the preferred embodiment includes a series of generally circular elements secured in a sandwichlike fashion. More specifically, included is a buttonholder plate means 126 having a button cover plate means 128 secured to the top thereof and a button supporting spring means 130 secured to the bottom thereof. The buttonholder plate 126 is provided with a series of aperture means such as apertures 132, 134, and 136, as well as a series of step means 138, 140 and 142. The aperture means are designed to receive a button, as will be hereafter discussed and include at least one button wedging surface means, such as 143. Reference should be made to FIG. 6*a* for a bottom view of the button conveyor assembly wherein buttons 145, 147 and 149 are shown carried in the recesses. A spring assembly means, such as spring assembly means 144, carried in step 142 facilitates the driving force to urge the button means into an abutting relationship with the button wedging surface 143. The spring assembly means 144 includes a positioning spring wire means 146, a spring clamp 148 and a series of threaded screw means 150 for threaded engagement with a correspondingly located and aligned hole means, such as 152. Referring now to FIGS. 6*a*, 9 and 11 and ignoring the other elements involved as above discussed, the button conveyor means will be indexed through the series of predetermined positions which are allowable by the positive sequential locking means. Position A is in the loading step wherein a button means such as 145 is delivered by the button loader means 11, (as shown in FIG. 16) having only the guide track 154 and chute means 156 shown, to a position adjacent the first of said button recess means, such as 132. In position B, the button 147 has been indexed for the orientation step as will hereafter be discussed, while in position C the button 49 is positioned for the sewing step. As the button conveyor 42 is moved in a counterclockwise direction, as observed from a top view as in FIG. 2*a*, or clockwise as viewed in FIG. 6 *a*, the button, for example button 145, engages the leading edge means or point means 158 and is urged thereafong against cam surface means 160 which is a part of guide track bracket means 162. The camming action developed by the movement of the button conveyor 42 against the cam surface 160 is sufficient to force the button into the recess thereby loading the positioning spring wire means 146 such that it continuously urges the bottom into the V shaped groove or button wedging surface 166 which is identical to wedging means 143 as previously discussed. As is apparent, movement in either an upward or downward direction is prevented by the button cover plate 128 and the supporting spring means 130 whose particular design will be more fully hereafter discussed.

As is apparent, the buttons are fed to the button conveyor means by the button loader means 11 and thereafter cammed into a given button recess, however, no consideration has been given to the orientation of the buttonholes with respect to the conveyor means. As is apparent, the button must be oriented to a predetermined position such that the needle as it passes through its work cycle in conjunction with the movement of the clamp can find each buttonhole in the proper sequence.

Referring now to FIGS. 1, 2, 4 and 6, the button orientating means 168 will be discussed. The button orientating means 168 includes an orientating pin bushing means 170, an orientating cap means 172 and an orientating pin means 174. Referring to FIG. 6, the assembly is shown in an assembled form being carried in a bushing means 176 which is in turn carried in an aperture means 178 that is located in support bracket means 36. Orientating pin means 174 has adjacent its top end 173 a threaded portion for engagement with cap means 172. Extending out from the bottom portion means 175 thereof are a series of prong or buttonhole entering engaging means 180. In operation prong means 180 when moved into a contacting position with a button will abut against a section of the solid web area between the actual buttonholes. In order to locate the prongs 180 in the buttonholes, the entire orientating means 168 is rotated. Once the prong means 180 locate the buttonholes, the rotaty motion continues in order to achieve the proper predetermined position. It has been found that when a four-hole button is employed, the orientating means 168 must be rotated through an absolute minimum of 90 degrees. This is so that in the course of turning the prongs they can align themselves with the buttonholes, irrespective of the original angular orientation of the button, and then move the button such that the holes assume the proper predetermined position. When two-hole buttons are employed, the orientating means 168 must be rotated through a minimum of 180 degrees in order to achieve the desired results. Referring now to FIGS. 2*a*, 4 and 6, the manner in which rotating motion is imparted to the orienting means 168 will be discussed. Since no clutch means is used to carry the orientating means 168, a simple bushing means 176 is used instead, and any movement of drive gear 68 in either a clockwise or counterclockwise direction will transfer movement thereto by the engagement of the respective gear teeth, such as 181 and 183. Thus, by controlling the diameters and numbers of gear teeth the amount or degree of rotational movement transferred from one to the other can be controlled. An additional means is provided for disengaging the prong means 180 from the buttonholes once the proper position has been achieved. The disengaging assembly 184, as shown in FIGS. 1 and 4, includes an elongated or leaf spring means 186 pivotally mounted on pin means 190 carried by bracket means 30. It will be apparent as a result of this pivotal mounting that spring means 186 is hinged to rotate about pin means 190. A first end means 192 slidingly engages a pin 193 carried by bracket means 194. It should be noted that bracket means 194 is affixed to the frame of the sewing machine thus, as the clamp moves in a vertical manner the spring means 186 having first end 192 constrained in a vertical plane will be pivoted around pin 190 such that a second end means 196 will move in a vertical plane of a degree different from that of bracket means 30. A spring means 198 located at the very left extreme of spring means 192 continually urges it in an upward direction. An aperture or gap means 199 is provided in end 196, as shown in FIG. 4. This gap 199 carries the shaft means 200 of orientating pin cap means 172. A sandwich relationship is achieved by the top and bottom elements of the orientating pin cap 172. In operation as the clamp means or bracket means 30 moves upwardly it comes nearer the bottom of pin 193, this forces the spring means 186 to pivot about pin 190 which in turn pulls the entire orientating assembly means 168 in a vertical or at least generally vertical direction with respect to the support bracket means 36. The amount of vertical travel, although not great, is sufficient to disengage the prong means 180 from the buttonholes.

Referring now to FIGS. 9 through 14, two embodiments of the means operative to forceably remove the bottom from the recess subsequent to the sewing thereof to a fabric are shown. Reference will first be made to FIGS. 9 through 11 wherein is shown a first preferred embodiment. The button unloading means or button unloading spring means 204 in the preferred embodiment is an elongated sheet section having a series of bends and folds therein. As shown in FIG. 10 the first edge 203 of the unloading spring 204 is secured to the support bracket means 36 on the bottom side thereof by suitable means, such as a bolt and threaded means. The button unloading spring means 204 as so secured is in a loaded form, as shown in FIG. 10. That is, when the clamp and related assemblies are raised in a vertical plane the unloading spring will bend downwardly toward the feed plate means 209, which is in turn underlaid and supported by the needle plate means 206. In the clamped position, as shown in FIG. 10, the unloading spring means 204, the feed plate means 209, and the spring means 130 of button conveyor 42 lie in parallel adjacent spaced apart planes. The body portion means 208 is shown in FIG. 11 to overlap position B, which is where the orientating means 168 acts upon the button to position the holes in a predetermined manner. This overlay or underlay depending on your view, avoids any problems which might arise from too strong a downward force being delivered by the orientating means 168 which would disturb the button in the recess. Additionally, if a thick material or fabric 207 were supported or were sandwiched between the feed plate 209 and the unloading spring 204 and the clamp was down, with its related assemblies, this would very likely create a space between the feed plate 209 and the spring means 130 of the conveyor means 42 at the rear or left extremes thereof. As is apparent, in these circumstances the button unloading spring, due to its underlying the B station, would prevent the button from being dislodged vertically from the recess.

Now assuming a button has been sewn to the fabric 207, which would be in the C position, as shown in FIGS. 9 and 11, as will be hereafter discussed, the next step in the sequence of the work cycle of the button sewing machine is the raising of the clamp means 30 which, as is apparent causes all of the aforediscussed components to be raised therewith. For the sake of simplicity the raising step will be discussed only in connection with the conveyor means 42. As the button conveyor 42 moves forwardly the button being sewn to the material or fabric 207 by a given length of thread is pulled downwardly out of the recess. This result is achieved because, as previously mentioned, button unloading spring means 204 is loaded such that it is being continuously urged downwardly against the feed plate 209, thus, it continues to hold the fabric 207 adjacent the feed plate 209 while the button conveyor 42 rises. Referring briefly to FIG. 4 and the supporting spring means 130, it will be appreciated that the finger means, such as 212, positioned at ends of the arm means, such as 214, are sufficiently flexible such that they can be bent downwardly to allow the escape of the button 147. Referring now back to FIGS. 9 and 11 it will be noted that a gap means 216 has been proivded in the unloading spring means 204 adjacent the C station.

The gap means 216 allows the button unloading spring via its body poriton 208 and a finger means 218 to exert a force against the fabric during this pulling up or raising cycle of the button conveyor means. This prevents any bending or twisting of the fabric and insures that the button will always be removed from the recess, the thread pattern passing through the buttonholes and the material being narrow enough that it can safely enter the gap 216 without binding on the sides thereof.

The button unloading spring, as shown in FIGS. 9, 10 and 11, is designed to be employed with a button sewing machine which indexes to the left. That is, in FIG. 9 the direction of travel of the material would be from the top to the bottom of the page. In FIGS. 12, 13 and 14 a second embodiment of a button unloading spring is disclosed. This particular spring is designed to be employed with a button sewing machine which indexes to the right or from the bottom to the top of the page. In this particular embodiment an additional projection means 220 is provided on the button unloading spring means 204*a* to securely hold the fabric against the needle plate means. It should be noted that in both of these embodiments a hook or tab means 222, as shown in FIG. 10, extends up and over the top portion of the button conveyor 42. This hook means 222 is employed when a button sewing machine not having a knife assembly is employed. As is known in the art, a button sewing machine not employing a knife breaks the thread below the plate 206 during the upward or vertical movement of the clamp. In order to insure the continued breakage of the thread beneath the needle plate, it is necessary that immediately after the button has been pulled from the recess that the button unloading spring 204 be also engaged and raised. The hook means 222 being positioned sufficiently above the button conveyor means 42 allows for the removal or pulling out of the button from the recess and then before the thread breaks at some undesirable location raises the button unloading spring such that the thread breaking step is performed in the same manner as that shown in the prior art.

The sewing machine as shown and as herein discussed is provided with a thread cutting assembly which cuts or interrupts the thread at a predetermined time during the work cycle. Referring now to FIGS. 1, 4, 7 and 8 wherein the knife assembly means 201 is shown, the knife means 253 directly underlays the needle plate means 206. At the end of the sewing cycle the thread, whether it is to be broken or cut, is wound around the hook means 226, for example, as is shown in FIG. 3. In the preferred embodiment it is desirous to cut this thread rather than break it in view of the fact the point of breakage is not nearly as predeterminable. Returning now to FIGS. 1, 7 and 8, a standard arm and linkage means 228 is employed to deliver force to a lever means 230. As a result of the pivot points, lever means 230, as shown in FIG. 7, reciprocates in a generally horizontal plane that is, from left to right or vice versa depending on the point of the cycle as is well-known in the art. A cutting knife actuation lever means 232 is connected to lever means 230 whereby motion is transferred therebetween. The cutting knife actuation lever assembly means includes a plate means 234 having slot means 236 and 238 cut therein. Positioned in the slot means 236 and 238 are bolt means 244 and 246 which extend through the slots and are secured to surface means 248 of supporting arm means 16 as is well-known in the art. As is apparent, this slot system allows the cutting knife actuation lever means 232 to be slid by lever means 230 back and forth a predetermined distance. Positioned adjacent to the cutting knife actuation lever means 232 is a knife driving lever or bell crank lever means 250. A force transfer juncture is provided therebetween such that the movement of the lever 230 is transferred, in the preferred embodiment, to a first leg means 252 by a slot and pin assembly 254, the pin means 255 being carried on lever 232 and the slot 257 being cut in leg 252. Bell crank lever means 250 is pivotally secured in the preferred embodiment to the bottom side of the needle plate 206 and is capable of rotating a given number of degrees therearound. The second arm means 256 thereof pivotally mounts first or lower knife means 258, the major planes thereof lying at generally a right angle to each other. As a result, when bell crank means 250 is pivoted the lower knife means 258 moves either toward the needle hole 260 of the needle plate 206 or away from it. It should be noted that the knife edge of lower knife means 258 extends along edge means 264. Located adjacent lower knife means 258 is upper knife means 266 having a cutting knife edge means 268. The arrangement of these two knife means is such that when the bell crank lever means 250 is pivoted and lower knife means 258 is moved upwardly, a scissor action is achieved between the two knife edges, such that the entire assembly is either moved forwardly or backwardly with the closing or opening of the knife edges. In the preferred embodiment the upper knife means 266 is generally L shaped and includes first and second means 261 and 263 which are fixedly secured. These sections are supported at a first end 267 by support means 271 and have the knife edge 268 on the inner side of the second portion 263 of the L shaped member 266. The supporting means 271 is designed to allow for adjustment of the knife assembly such that the proper cutting cycle can be achieved. This includes the sleeve means 273 which provides a bearing surface for the apertures 275 and 277 and a pin or screw means 279. An aperture 281 is provided in sleeve 273 which is of a greater diameter than screw 279; thus the screw 279 has a certain amount of freedom which can be employed to align the blades 264 and 268 to properly engage the thread. Specifically, screw 279 is passed through the sleeve and loosely engages with a threaded hole (not shown) in the needle plate 206. The necessary alignment is then made to adjust the knife point with respect to the needle hole 260, thereafter screw 279 is torqued tight to lock the elements into position. The design and resultant work cycle is such that in order to perform its function and not interfere with the subsequent functions of the sewing machine, the knife assembly means must extend the knife cutting edges outwardly a given distance to sever a thread looped around the hook 226 and then withdraw to the initial position out of the way of other machine functions.

A wiper assembly 274, as shown in FIG. 1, is provided to sweep across the sewing area after the knife assembly has cut the thread and pulled the thread out of the sewing area to avoid any entanglement thereof and facilitate the next sewing cycle. The wiper means 274 includes a lever means 276 which is secured to and follows the movement of the clamp actuating device. One end means 278 thereof journals a plate means 280 fitting into a specifically designed elongated slot means 282. Extending forwardly off one end of the plate means 280 is the wiper wire 284, the other end 285 of the plate thereof being pivotally secured to the frame of the machine in any suitable manner. As is apparent, when the clamp lifting mechanism reaches a given point in its travel, the lever means 276 will move in the slot means 282 and cause the wiper wire 284 to be swept across the sewing area from the front thereof, thus avoiding any conflicts with other elements of the assembly.

If it is desired to switch from one size button to another, a number of adjustments can be made to achieve this result. The guide track bracket 162 is provided with elongated slot means 300 and 302, which allow movement of the bracket forwardly or rearwardly depending on the button size. A second set of slot means 304 and 306 is provided in conjunction with the guide track 154 and serves a similar purpose. Since the spring assemblies such as 144 are secured to cover plate 128, rotational adjustment thereof will allow the spring location to be moved with regard to the recess. As a result, a constant spring tension can be exerted against a button even when the size thereof is changed. The proper movement in the sequencing cycle or rotational movement of the conveyor means 42 is determined by when pin 90*a* abuts surface 105. As previously stated, escapement means 82 is carried in an eccentric sleeve means 84 which can be rotated via lever 106, such that the point of abutment can be varied. As is apparent, the point of abutment will determine the number of degrees through which the conveyor will rotate and so where the holes of a button are after a given sequencing step.

The orientating means 168 is also adapted to be convertible to handle buttons having two holes or four holes or for that matter any other type of platelike means. The gearing elements are such that sufficient rotation can be imparted to a given button, two or four hole, that it can be properly oriented with respect to the needle. In the case of a four-hole button at the sewing station, a diagonal line passing from one corner to the other will create an angle of 45° with a second line passing through the center of the button and the conveyor. With a two-hole button this angle will be 90°. Considering FIG. 6, it is apparent that if cap means 172 is unscrewed from orientating pin means 174, it can be rotated and reset the necessary amount, which in combination with the fixed rotation imparted by the gearing elements will properly position a given type of button at the sewing station.

In operation the fabric material to which a button is to be secured is placed beneath the conveyor assembly and adjacent to the feed plate. The clamp is then released to securely hold the fabric against the feed plate. As is apparent it is actually the bracket, designed to forcibly pull the button from the recess, which is in direct contact with the fabric. The other elements, conveyor, etc., involved in the assembly exert pressure thereupon from the top.

The first step in the operation is the feeding of a button by the button loader means to a place adjacent one of the recesses in the conveyor means. For the sake of clarity the recess wherein the button is loaded will be called the "A" station or position, the position wherein the buttonholes of the button are orientated will be called the "B" station and the position wherein the button is sewn to the fabric will be called the "C" station. As previously stated, as the button conveyor means is rotated the button is cammed into the recess such that the spring positioned therein and the V shaped groove in one of the walls thereof hold it sufficiently secure in place. It should be noted that in order to position a button in every one of the three stations when the button conveyor is initially empty, it becomes necessary to either actuate the overall assembly by hand or sew on a piece of scrap material twice until a button is advanced from the "A" to the "C" station.

For the sake of explanation, it will be assumed that there is now a button in each station or position above described. Focusing attention on the "B" position now, as the clamp moves downwardly to a fabric engaging position the sewing machine driven actuation assembly, via the drive lever, will move the seqencing assembly from the position shown in FIG. 2 to that shown in FIG. 2*a*. Just prior to this, however, during the time when the clamp was being lowered the orientating means was also being lowered until the pins were in engaging contact with either the perforated or unperforated section of the button in the "B" station. Because of the gearing assembly it is apparent that when the sequencing assemblage is loaded, the orientating means is rotated through a given angle. This results in the pins locating themselves in the buttonholes and rotating the button such that the buttonholes assume a predetermined positon. As will be appreciated, during this time another button is being sewn to the fabric at the "C" station and still another button is being positioned adjacent the recess at the "A" station.

Referring now to the "C" station and assuming that a button has just been secured to the fabric and the needle is withdrawing after making its final stitch, at this time the following sequence of events occurs in the general order as described.

First the clamp carrying all of the desired apparatus begins to raise from a fabric engaging position, because thread is still engaging the hook, upward motion of the fabric and button is retarded such that the button is or may be dislodged from the recess to varying degrees. The positive button disengaging spring, because it is spring-loaded in a downward manner is still holding the fabric to the feed plate even though the clamp has risen sufficiently to cause the thread to become taut. It will be noted that the fabric will be held to the feed plate by the thread until it is broken, etc. The action thereof also helps to keep the fabric and attached button from following the clamp and related assemblies and in so doing helps to urge the button still further out of the recess. Shortly hereafter during the time these other events are occuring the knife assembly is actuated and it moves outwardly and clips one leg of the thread engaging the hook. Once the thread has been clipped or interrupted the positive button disengaging spring becomes the sole means for the continuing disengagement of the button from the recess. As the clamp is moving upwardly during this it finally reaches a point where the release spring contacts the trigger which as previously stated is secured to the frame of the machine and thereby not subject to movement of the clamp. When the release spring is disengaged from the escapement gear assembly, the assembly is pulled in a counterclockwise manner rotating due to the fact of the action of its associated spring. When the escapement has been released from its locking or abutting engagement with the pins at the lower extremes of the buttonholder chuck it becomes apparent that the drive gear assembly, as shown in FIG. 2*a*, which is spring-loaded for movement in a clockwise direction will be free to pivot. However, prior to this pivoting action the pins of the button orientating means must be disengaged from the buttonholes such that free rotation of the button conveyor can take place. This disengagement is achieved by the elongated leaf spring, which is actuated by the movement of the clamp, to exert force against the upper extremes of the orientating means and move it upwardly faster than the clamp itself is moving. As a result, the orientating means is pulled upwardly such that the pins disengage the buttonholes before the escapement pivots to release one of the pins on the bottom of the button loader chuck. Now as the drive gear, as shown in FIG. 2*a*, rotates in a clockwise direction to release the spring tension thereon, force is transferred through the spur gear, etc., to the button conveyor to move the assembly counterclockwise a predetermined sequenced distance and to a position wherein the spring assumes a generally relaxed state. During this time it will also be appreciated that the clamp is still moving upward and the button has been disengaged from the recess by the downward action of the bracket or at least partially disengaged from the recess, thus as the button conveyor is moved in the predetermined sequential manner the positive button disengaging bracket means holds the fabric and the button by virtue of the thread sewn therebetween such that it is totally disengaged from the recess, and pulled down under the conveyor as the conveyor moves over the top thereof to advance a button from the "B" station to the "C" station. The empty recess moves to the "A" station where it again engages a button to be loaded during the next cycle. During this cycle at some predetermined point the wiper actuation apparatus has been moved to sweep the wiper wire across the sewing area thereby positioning the cut or broken thread in a position desirable to start the next work cycle. As is apparent, if no thread cutting knife were provided the action of the clamp during its upward movement would have broken the thread in the normal manner. The fabric with associated button can now be manually or machine moved to the next desired sewing location.

As previously stated, at the beginning of the work cycle the clamp is lowered to engage the fabric adjacent the feed plate. As this operation occurs the release spring is disengaged from the trigger wire and moves upwardly to engage the pin carried by the escapement means. This immediately locks the assembly as previously described against movement in a counterclockwise direction. Thereafter as the drive gear is being loaded to the position shown in FIG. 2*a* by the drive lever and related assemblies, the orientating means is acting on a button to move the holes into a predetermined position and the needle in the "C" station is sewing a button to a fabric. It should be noted that when the clamp was lowered the spring means that pops the orientating means out of the engaging position with the buttonholes works in the opposite manner to force the orientating means downwardly into contact with the button until the orientating means rotates the pins sufficiently in order that they find the holes in the button.

Thus it is apparent that there has been provided, in accordance with the invention, an Automatic Button Positioning Apparatus that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. Apparatus for delivering buttons to and removing them from the sewing station of a button sewing machine comprising:

button conveyor means;

button loader means including a chute means for feeding buttons to said conveyor means;

button securing recess means located in said conveyor means for accepting buttons from said loader means;

indexing means moving said conveyor means through a series of predetermined steps;

orientating means operative to position a button for sewing; and means operative to forceably remove a button from said recess means subsequent to its attachment to a fabric.

2. The apparatus of claim 1 wherein:

said button securing recess means includes a series of spring means; and said means operative to remove said button includes a bracket means positioned across the line of travel of said conveyor means.

3. The apparatus of claim 2 wherein:

said spring means are adjustable;

said button loader means includes a guide track bracket means which is adjustable to accommodate various button sizes; and said indexing means includes an eccentric cam means whereby the degree of movement of said indexing means can be varied.

4. The apparatus of claim 1 wherein:

said indexing means engages and delivers force to said orientating means; and said orientating means includes; pin means having buttonhole engaging means and carried by a support means whereby movement in a rotational as well as a vertical plane is facilitated, and an adjustment means whereby said pin means is repositionable with respect to said orientating means.

5. The apparatus of claim 1 wherein:

said button conveyor means is carried by clamp means mounted on said sewing machine; and said button conveyor means includes a disk means rotatably mounted having said button securing recess means located in the circumference thereof, said recess means including a button engaging surface means, a spring means operative to urge a button into said engaging surface and a support means operative to support at least a part of a button.

6. The apparatus of claim 5 wherein: said indexing means includes: a series of gear means;

a buttonholder chuck means driven by said gear means;

an escapement means sequentially engaging said buttonholder chuck means;

a locking lever means controlling movement of said escapement means; and a trigger means secured to said sewing machine unlocking said locking lever means at a predetermined point of travel of said clamp means.

7. An apparatus for delivering buttons to and removing them from the sewing station of a sewing machine, comprising clamp means, being mounted on the clamp means of said sewing machine comprising:

button conveyor means including a rotatable turret means having button securing recess means located in an outer edge thereof;

button loader means feeding buttons to said recess means;

cammed surface means for urging a button into said recess means;

indexing means including a positive sequential locking means;

orientating means for engaging a button in said recess means and rotating it to a predetermined position; and means operative to forceably remove a button from the recess subsequent to sewing to a fabric.

8. The apparatus of claim 7 wherein said clamp means moves vertically and horizontally.

9. Apparatus carried by the clamp means of a button sewing machine for delivering buttons to and removing them from the sewing station after sewing to a fabric comprising:

a disk conveyor means having a series of button receiving recess means and rotatable through a first button loading position, a second button orientation position and a third button sewing and ejection position;

feeder means delivering a button to said first position;

orientator means engaging and rotating a button to a predetermined position at said second position; and positive eject means positioned across the line of travel of said disk conveyor at said third position preventing movement of said fabric with a button sewed thereto.

10. A method for sewing a button to a fabric with a sewing machine comprising the steps of:

clamping a fabric to control movement thereof;

feeding a button adjacent a recess means located in a conveyor means;

moving said conveyor means a predetermined degree forcing said button into said recess means;

rotating said button into a predetermined position with an orientating means;

sewing the button to a fabric; and unclamping said fabric thereby; pulling said button partially from said recess means, interrupting the sewing thread, triggering movement of the conveyor means and moving said conveyor means forcing the button out of said recess means.

11. Apparatus comprising a clamp means for delivering buttons to and removing them from the sewing station of a button sewing machine which includes a button conveyor means, a button loader means, an indexing means and a button orientating means wherein the improvement comprises:

a positive button removal means including a fabric engaging surface means;

a thread straddling means, having an open end means, opening generally in the direction of feed of said sewing machine; and an actuation means causing force to be exerted by said fabric engaging surface means on said fabric.

12. The positive button removal means of claim 11 wherein:

a bracket means carried said fabric engaging means and said thread straddling means, said bracket means being connected to said clamp means whereby movement of said clamp means is followed over part of the work cycle thereof.

13. The positive button removal means of claim 12 wherein:

said button removal means follows movement of said clamp means; and said actuation means includes a link means providing delay of movement of said fabric engaging during movement of said clamp means.

14. Apparatus for delivering individual platelike means to and removing them from the work station of a cyclic machine comprising:

conveyor means transporting said individual platelike means;

loader means including a chute for feeding said platelike means to said conveyor means;

recess means located in said conveyor means for accepting platelike means from said loader means;

indexing means moving said conveyor means through a series of predetermined steps;

orientating means operative to move said platelike means into a predetermined location; and means operative to forceably remove said platelike means from said recess means.

15. Apparatus carried on a movable clamp means for deliverying individual platelike means to and removing them from a work station comprising:

a disk conveyor means having a series of platelike means receiving recess means and rotatable through a first platelike means loading position, a second platelike means orientation position and a third working and ejection position;

feeder means delivering said platelike means to said first position;

orientator means engaging and moving said platelike means to a predetermined position while at said second position; and positive eject means positioned across the line of travel of said disk conveyor means at said third position disengaging said platelike means from said recess means.

* * * * *